US005431830A

United States Patent [19]

Erdemir

[11] Patent Number: 5,431,830

[45] Date of Patent: Jul. 11, 1995

[54] LUBRICATION FROM MIXTURE OF BORIC ACID WITH OILS AND GREASES

[75] Inventor: Ali Erdemir, Naperville, Ill.

[73] Assignee: ARCH Development Corp., Argonne, Ill.

[21] Appl. No.: 255,231

[22] Filed: Jun. 7, 1994

Related U.S. Application Data

[63] Continuation of Ser. No. 899,665, Jun. 16, 1992, abandoned.

[51] Int. Cl.[6] ..... C10M 141/04; C10M 125/26

[52] U.S. Cl. ..... 252/25; 252/29; 252/30

[58] Field of Search ..... 252/29, 25, 30

[56] References Cited

U.S. PATENT DOCUMENTS

| | | | |
|---|---|---|---|
| 905,649 | 1/1908 | Chapman | 252/30 |
| 3,788,987 | 1/1974 | Bartlett . | |
| 4,144,166 | 3/1979 | DeJovine . | |
| 4,204,968 | 5/1980 | Mack et al. . | |
| 4,297,227 | 10/1981 | Whitte et al. | 252/25 |
| 4,305,831 | 12/1981 | Johnson, III et al. . | |
| 4,411,804 | 10/1983 | DeVries | 252/30 |
| 4,534,872 | 8/1985 | Horodysky et al. . | |
| 4,534,873 | 8/1985 | Clark . | |
| 4,713,186 | 12/1987 | Kristen et al. . | |
| 4,715,972 | 12/1987 | Pacholke | 252/30 |
| 4,735,146 | 4/1988 | Wallace | 252/30 |
| 4,858,534 | 8/1989 | Wallace | 252/30 |
| 4,995,994 | 2/1991 | Singer . | |
| 5,006,270 | 4/1991 | Farng et al. . | |
| 5,093,015 | 3/1992 | Oldiges . | |
| 5,173,204 | 12/1992 | Chiddick et al. | 252/30 |

*Primary Examiner*—Margaret Medley
*Attorney, Agent, or Firm*—Reinhart, Boerner, Van Deuren, Norris & Rieselbach

[57] ABSTRACT

Lubricating compositions including crystalline boric acid and a base lubricant selected from oils, greases and the like. The lubricity of conventional oils and greases can also be improved by adding concentrates of boric acid.

6 Claims, No Drawings

LUBRICATION FROM MIXTURE OF BORIC ACID WITH OILS AND GREASES

This invention was made with Government support under Contract No. W-31-109-ENG-38 awarded by the Department of Energy. The Government has certain rights in this invention.

This is a continuation of application Ser. No. 07/899,665, filed on Jun. 16, 1992, now abandoned.

This invention is directed to an improved lubricant prepared from a mixture of boric acid and oil or grease or other such base medium lubricant, This invention also relates to an improved self-lubricating composite lubricant prepared from a mixture of boric acid and/or boric acid-forming boron oxide and organic polymers. More particularly, the invention relates to a mixture containing boric acid particles in a mixture and/or suspension with a particular range of particle sizes and amounts. Lubricants serve an important function in preserving machine components and extending machine operating lifetimes. Optimization of lubricant properties has remained a primary objective as machines are operated under more demanding and difficult conditions associated with increased efficiency and performance. Numerous additives have been developed, but much remains to be done to accommodate the increased demands now being made of lubricants.

It is therefore an object of the invention to provide an improved lubricant.

It is another object of the invention to provide a novel lubricant additive.

It is a further object of the invention to provide an improved solid phase lubricant additive.

It is an additional object of the invention to provide a novel lubricant of boric acid solids dispersed in a base lubricant.

It is yet another object of the invention to provide an improved method of lubricating ceramic and/or metal components using a boric acid dispersed in a base lubricant.

It is still a further object of the invention to provide a novel multifunctional lubricant having boric acid and polymer solids additives to a base lubricant.

It is also an additional object of the invention to provide an improved solid lubricant and method of use for a boric acid/polymer mixture.

Other advantages and details of the invention will become apparent from the description provided hereinafter along with the appended claims.

DETAILED DESCRIPTION OF PREFERRED EMBODIMENTS

In one of the preferred forms of the invention, an additive to a base lubricant takes the form of a dispersion of boric acid or boric acid-forming boron oxide. The boric acid additive of this embodiment is available in the form of solid particles with particle sizes in the range of about 0.5 to 100 microns in diameter. The preferred form of this additive is essentially boric acid powders and is available from U.S. Borax Co. of Los Angles, Calif. The resulting lubricant with boric acid dispersion therein takes advantage of the low friction properties of boric acid when suspended in lubricants. Examples of base lubricants are oils such as petroleum based oils, synthetic oils, mineral oils, hydrocarbon based oils and silicon oils or other suitable lubricants which preferably do not react with boric acid. For example, undesirable reactions can include destruction or substantial disturbance of the layered crystal structure of boric acid. Without limiting the scope of the invention it is believed the particles of boric acid, under high pressure and frictional traction, interact with load-bearing surfaces to provide excellent resilience and load carrying capacity. The layer structure of crystalline boric acid particles can slide over each other with relative ease and can reduce friction and wear.

In this invention boric acid is particularly useful for systems running at temperatures up to about 170° C. The boric acid is then dispersed as a component in base lubricants with the result being a substantially improved performance for the mixture.

In another embodiment boric acid and boric acid-forming boric oxide can be mixed with polymers and used as a lubricant for temperatures up to about 170° C. The resulting lubricant provides an improved performance for the mixture. Tests show an improvement of the order of 10–1000% over that for a corresponding conventional lubricant, particularly for lubricating systems where the lubricant is being circulated.

In the most preferred embodiment the particle size for boric acid is from about 0.2 to 40 microns to facilitate the formation of a stable suspension with the boric acid being present in a amount of at least 0.1 to 0.2% by weight. The amount of solid particles that can be mixed and/or dispersed in the oil will be dependent on the size of the particle. The smaller the size of particle, the greater the amount of particles that can be suspended in oil. In general, the preferred range for oils is about 0.5 to 50% by weight and for greases is about 1–50% by weight with the most preferred range being 1–15% for oils and 1–20% for greases.

The size and amount of boric acid particles to be added to oils and greases will be generally determined by the intended use of the resulting lubricant mixture having the solid particles in suspension. Conventional equipment and techniques can be employed to achieve substantially uniform or stable dispersion or distribution of the additive in the final mixture. Stable dispersion means a mixture in which solid lubricating particles remain as separate, discrete particles in the presence of a stabilizer and a carrier fluid medium. Methods of achieving a uniform dispersion of the particles in the base lubricant are well-known to those in the art. Concentrates comprising higher amounts of boric acid can also be prepared first and then added to conventional oils or greases. The lubricants can, in addition, contain other additives which are added to improve the fundamental properties of lubricants even further. Such additives may include: antioxidants, metal passivators, rust inhibitors, viscosity index improvers, pour point depressants, dispersants, detergents, extreme pressure additives of liquid and solid types and anti-wear additives and solid lubricant particles selected from the group consisting of graphite, molybdenum disulfide and PTFE. The base lubricant greases useful in the preparation of the lubricant composition of the invention can be any of the known greases employed as bases for extreme pressure applications.

For mixtures consisting of boric acid and/or boric acid-forming boric oxide in solid polymers, an improvement in performance is achieved of the order of 2 to 6 times. Boric oxide particles mixed with polymers form boric acid particles on the exposed surface by reacting with moisture in the surrounding atmosphere. The base polymers used in friction and wear applications are well-known to those in the art of making self-lubricating polymer composites. It is preferred that the particle size of boric acid and boric acid-forming boric oxide be in the range of about 1 to 100 microns, and in an amount of 0.1 to 40% by weight. The most preferred size and amount depends on the intended use of the polymers. These polymers can include, for example, plastics, rubbers, elastomers, polyimides, nylons, epoxy resins and teflon. The selection of specific polymer for the mixture varies with the intended use.

EXAMPLES

The following examples are intended to be merely illustrative of the invention and not in limitation thereof. Unless otherwise indicated, all quantities are by weight.

Example 1

Mixture of boric acid and lubricant oil or grease.

This example illustrates the extent of performance improvement with the use of a mixture of boric acid and oil or grease. In this example, a commercially available mineral and motor oil or grease are mixed with boric acid powder having particle sizes from about 0.2–40 microns in amounts ranging from 1 to 50% by weight. The mixture was put in a glass container and stirred vigorously by means of a magnetic stirring device for a period of at least 2 hours. The mixture was then used as a lubricant on a wear test machine whose function and main features may be found in the 1990 Annual Book of ASTM Standards, Volume 3.02, Section 3, pages 391–395. In the tests, steel (440C, and 52100) and alumina ($Al_2O_3$) pins with a hemispherical tip radius of 5 in (127 mm) was secured on the pin-holder of the wear test machine and pressed against a rotating steel or alumina disk. A specific load is applied through a lever system which presses the stationary pin-holder downward against the rotating disk. The lubricant under test covers the stationary pin. After the test which is run for a specified distance at specified temperature, pressure and speed, the steady-state friction coefficient is obtained from a chart recorder and is shown in Table I. The wear rate was calculated from a formula given in the 1990 Annual Book of ASTM Standards, Volume 3.02, Section 3, page 394, expressed in cubic millimeter per meter ($mm^3/m$). The wear results and friction coefficient obtained are summarized in Table II.

TABLE 1

Friction test results from various pin and disk pairs under different loads. Test conditions: Speed, 1–3 mm/s; Temperature, 22–25° C.; 440C and 52100 steel pins and disks

| Lubricant | Pin/Disk Material | Load (kg) | Sliding Distance (m) | Friction Co-efficient |
|---|---|---|---|---|
| Base Mineral Oil | 440C/52100 | 5 | 27 | 0.15 |
| 50% by weight Boric Acid and Base Mineral Oil | 440C/52100 | 5 | 27 | 0.02 |
| 10% by weight Boric Acid and Base Mineral Oil | 440C/52100 | 4 | 26 | 0.01 |
| 10% by weight Boric Acid and Base Mineral Oil | 440C/52100 | 2 | 2000 | 0.03 |
| 10% by weight Boric Acid and Base Mineral Oil | 440C/52100 | 2 | 450 | 0.03 |
| 15W40 Motor Oil | 440C/440C | 2 | 180 | 0.11 |
| 1% by weight Boric Acid and 15W40 Oil | 440C/440C | 2 | 180 | 0.09 |
| Petroleum Base Grease | 440C/440C | 5 | 0.11 | |

TABLE 1-continued

Friction test results from various pin and disk pairs under different loads. Test conditions: Speed, 1–3 mm/s; Temperature, 22–25° C.; 440C and 52100 steel pins and disks

| Lubricant | Pin/Disk Material | Load (kg) | Sliding Distance (m) | Friction Co-efficient |
|---|---|---|---|---|
| 20% by weight Boric Acid and Petroleum Base Grease | 440C/440C | 5 | | 0.05–0.07 |

TABLE II

Wear Test on Pin-on-disk Machine. Test conditions: Load, 2 kg; Speed, 1–3 mm/s; Temperature, 22–25° C.; 440C, 52100 steel and alumina pins and/or disks

| Lubricant | Pin/Disk Material | Slid-ing Dis-tance (m) | tion Coeffi-cient | Fric-Wear rate ($mm^3/m$) |
|---|---|---|---|---|
| Base Mineral Oil | $52100/AL_2O_3$ | 57 | 0.16 | $1.1 \times 10^{-4}$ |
| 10% by weight Boric Acid and Base Mineral Oil | $52100/AL_2O_3$ | 70 | 0.03 | $2.0 \times 10^{-6}$ |
| Base Mineral Oil | $Al_2O_3/AL_2O_3$ | 80 | 0.25 | $2.8 \times 10^{-4}$ |
| 10% by weight Boric Acid and Base Mineral Oil | $Al_2O_3/AL_2O_3$ | 92 | 0.025 | $2.6 \times 10^{-6}$ |

Example 2

Mixture of boric acid and boric acid-forming boric oxide and polymer. This example illustrates the extent of performance improvement with the use of a mixture of boric acid-forming boric oxide and a polymer epoxy. In this example, a commercially available epoxy resin and appropriate hardener is mixed with boric acid forming-boric oxide particles having particle sizes from about 0.2–40 microns in the amount of 10% by weight. The mixture was put in a glass container and stirred vigorously until a uniform mixture is obtained. The mixture was then cast in a disk-shaped mold and let harden overnight. It was then tested on a wear test machine whose main feature and test procedure may be found in the 1990 Annual Book of ASTM Standards, Volume 3.02, Section 3, pages 391–395. In the tests, steel (440C) balls with a diameter of ⅜ in (9,525 mm) was used and secured on the ball-holder of the wear test machine and pressed against the rotating epoxy disk with and without boric acid forming-boric oxide particles in it. Specific load is applied through a lever system which presses the stationary pinholder downward against the rotating polymer epoxy disk. After the test which is run for a specified distance at 9pecified temperature, pressure and speed, the steady-state friction coefficient is obtained from a chart recorder and given in Table III.

TABLE III

| Ball/Disk Material | Friction Coefficient | Wear |
|---|---|---|
| 440C/Epoxy without Boric oxide | 0.65 | significant wear on ball significant amount of wear on disk |
| 440C/Epoxy with 10% by Weight Boric oxide | 0.13 | boric acid transfer to sliding ball surface, only minor scratches were visible at 50× magnification on an |

TABLE III-continued

| Ball/Disk Material | Friction Coefficient | Wear |
|---|---|---|
| | | optical microscope. Insignificant wear on disk. |

The above results demonstrate that with a mixture of boric acid and an oil lubricant, the friction coefficients are reduced by 10 to over 1000% below those of the unmixed lubricant itself. The wear rates of pins are reduced by factors of 50 to 100 below those of pins tested in unmixed oil itself. With the mixture of boric acid and a polymer (epoxy resin), the friction coefficient is reduced by a factor of 5 below that of unmixed polymer itself.

While this invention has been described by way of various specific examples and embodiments, it is important to understand that the invention is not limited thereto, and that the invention can be practiced in a number of ways within the scope of the following claims.

What is claimed is:

1. A lubricating composition comprising from about 0.5 to 50% by weight of solid state layered crystalline boric acid additive having a particle size from about 0.2 to 40 microns, and a base lubricant, said lubricant selected from the group consisting of petroleum oils, mineral oils, synthetic oils, silicon oils, mixtures of said oils, mineral greases, and synthetic-based greases, said boric acid additive substantially unsolvated by a solvent such that the layered crystalline structure of said boric acid additive is not disturbed.

2. The lubricating composition as defined in claim 1 further including additives selected from the group consisting of antioxidants, metal passivators, rust inhibitors, viscosity index improvers, pour point depressants, dispersants, detergents, extreme pressure additives, antiwear additives and mixtures thereof.

3. The lubricating composition as defined in claim 1 further including a dispersant in an amount sufficient to maintain said solid state boric acid homogeneously dispersed throughout said base lubricant.

4. The lubricating composition as defined in claim 1 wherein said base lubricant is a grease.

5. The lubricating composition as defined in claim 1 further including solid lubricant particles selected from the group consisting of graphite, molybdenum disulfide and PTFE.

6. The lubricating composition as defined in claim 1 wherein said base lubricant is a mixture of a mineral and a synthetic oil.

* * * * *